US008967433B2

(12) United States Patent
McKenna

(10) Patent No.: US 8,967,433 B2
(45) Date of Patent: Mar. 3, 2015

(54) BAG-IN-BOX DISPENSING SPOUT CAPTURE MECHANISM

(75) Inventor: Kieran McKenna, Dublin (IE)

(73) Assignee: Aqueduct Invest, Dublin (IE)

( * ) Notice: Subject to any disclaimer, the term of this patent is extended or adjusted under 35 U.S.C. 154(b) by 260 days.

(21) Appl. No.: 13/502,913

(22) PCT Filed: Aug. 17, 2010

(86) PCT No.: PCT/EP2010/061991

§ 371 (c)(1),
(2), (4) Date: Aug. 27, 2012

(87) PCT Pub. No.: WO2011/020837

PCT Pub. Date: Feb. 24, 2011

(65) Prior Publication Data

US 2012/0318824 A1 Dec. 20, 2012

(30) Foreign Application Priority Data

Aug. 18, 2009 (IE) ..... S2009/0635
Dec. 22, 2009 (IE) ..... S2009/0964

(51) Int. Cl.
*B67D 7/06* (2010.01)
*B65D 77/06* (2006.01)
(Continued)

(52) U.S. Cl.
CPC ..... *B65D 77/067* (2013.01); *B67D 3/0083* (2013.01); *B67D 3/04* (2013.01)
USPC ..... 222/185.1; 222/105; 222/573

(58) Field of Classification Search
CPC ..... B65D 83/0055; B65D 2231/001; B65D 77/065; B65D 77/067; B67D 1/0001; B67D 1/0004; B67D 1/0462; B67D 3/0067; B67D 3/0083; B67D 7/005; B67D 7/0216; B67D 7/0255; B67D 2001/0827; B67D 3/04
USPC ..... 222/105, 183, 185.1, 573; 229/117.3, 229/117.35
See application file for complete search history.

(56) References Cited

U.S. PATENT DOCUMENTS 268,313 A * 11/1882 Stokes et al. ..... 222/183
3,325,058 A * 6/1967 West, Jr. ..... 222/146.5
3,448,897 A * 6/1969 Sterling ..... 222/105
(Continued)

FOREIGN PATENT DOCUMENTS

DE 3914398 A1 10/1990
EP 1520836 A1 4/2005
(Continued)

OTHER PUBLICATIONS

International Search Report and Written Opinion issued in corresponding International Application No. PCT/EP2010/061991 on Jul. 12, 2010.

*Primary Examiner* — Patrick M Buechner
(74) *Attorney, Agent, or Firm* — Ascenda Law Group PC

(57) ABSTRACT

A capture mechanism for a dispensing spout of a bag-in-box liquid dispenser. The dispenser is adapted to enable the dispensing spout protrude through at least the base of its box. The capture mechanism contains a component for capturing a dispensing spout of a bag-in-box liquid dispenser. When in use with at least a portion of the capture mechanism cooperating with the box of a bag-in-box liquid dispenser adapted to enable its dispensing spout protrude through at least the base of its box, the capturing component is positioned to maintain the dispensing spout in a low dispensing position relative to the level of the base of the box.

27 Claims, 19 Drawing Sheets

(51) Int. Cl.
*B67D 3/00* (2006.01)
*B67D 3/04* (2006.01)

(56) References Cited

U.S. PATENT DOCUMENTS

| | | | | |
|---|---|---|---|---|
| 5,186,359 | A * | 2/1993 | Brown et al. | 222/1 |
| 5,419,448 | A * | 5/1995 | Watson | 220/4.28 |
| 5,445,289 | A * | 8/1995 | Owen | 222/105 |
| 6,347,718 | B1 * | 2/2002 | Karpisek | 220/1.6 |
| 6,390,331 | B2 * | 5/2002 | Schutz | 222/105 |
| 6,827,237 | B2 | 12/2004 | Yorn et al. | |
| 7,048,146 | B2 | 5/2006 | Verespej et al. | |
| 2003/0155372 | A1 | 8/2003 | Yorn | |
| 2005/0236426 | A1 | 10/2005 | Verespej | |
| 2007/0039974 | A1 * | 2/2007 | Lloyd | 222/105 |
| 2009/0084834 | A1 * | 4/2009 | Duyst | 229/117.3 |

FOREIGN PATENT DOCUMENTS

| | | | | |
|---|---|---|---|---|
| GB | 2188305 | A | 9/1987 | |
| GB | 2246764 | A * | 2/1992 | B65D 77/06 |
| WO | 2009-060087 | | 5/2009 | |
| WO | 2011-020837 | | 2/2011 | |

* cited by examiner

A

B

A

B

BAG-IN-BOX DISPENSING SPOUT CAPTURE MECHANISM

FIELD OF THE INVENTION

This invention relates generally to beverage dispensing, in particular to a capture mechanism for a dispensing spout of a bag-in-box dispensing system.

BACKGROUND TO THE INVENTION

In the field of beverage and liquid systems an apparatus, commonly known as a bag-in-box package, is used to store and dispense beverages such as soft drinks, fruit juices, water, or alcohol, but not limited thereto. Typically such bag-in-box packages comprise a collapsible bag or bladder disposed within a cardboard or plastic box. The bag is typically provided with a dispensing spout which protrudes through a side wall of the box for dispensing liquid stored within the bag.

One of the problems associated with early prior art bag-in-box packaging is that the tap or spout needs to be supported within one of the side walls of the box and this results in an accumulation of the liquid in the area of the box below the level of the tap or spout. Thus the residual portion of liquid remaining in the bag is wasted. It is cumbersome and awkward for a user to open the nearly empty box, remove the bag and to squeeze the remaining fluid out from the box. This problem is amplified when a bag and box container is located within a dispensing unit wherein access to the bag is restricted.

A number of attempts have been made to solve the above mentioned problems. European Patent No. EP 1 520 836, in the name of Model AG, discloses a bag-in-box dispensing apparatus in which the box is tilted at an angle to the dispensing apparatus to urge the liquid from the bag and box through a tap or spout. Another solution is proposed by US Patent Publication Number US 2003/0155372, which discloses a bag-in-box apparatus where the interior base of the box is sloped or terraced downwards towards the spout of the bag such that gravity helps the liquid towards the spout, as shown in FIG. 1 by the dotted lines. However this solution has been shown to be unsatisfactory as it still results in waste liquid forming at the base of the box.

The inventors of the present invention have overcome these problems with an improved bag-in-box system for dispensing liquids, as described in International Patent Application No. PCT/EP2008/065180. In the cited application, an extended section of the box is removable to permit the dispensing spout project through the box to a position lower than previously possible (substantially under the level of the base of said container) so that the liquid is fully dispensed without the need for additional manual force. This solution eliminates the requirement to manually squeeze the remaining liquid from the bag and is thus far more efficient.

A second improvement is to specifically introduce extra air into the bag which improves the dispensing rate of the fluid at lower volumes.

Although the bag-in-box system of PCT/EP2008/065180 is a significant improvement on the traditional bag-in-box systems, there is an underlying problem in that the spout may not remain in its lower dispensing position without external assistance. The applicants of the present invention have described in PCT/EP2008/065180 a capture mechanism to overcome this. However, the described capture mechanism is inconvenient to use. As one tries to manoeuvre the tap into the tap capture mechanism, the pressure of the water pressing out and against the tap makes the action of trying to manoeuvre the tap into the tap capture mechanism very cumbersome. The user has to contend with manoeuvring the tap into place whilst at the same time holding back a bulging bag of fluid.

The capture mechanism of the present invention overcomes some or all of the above-mentioned problems.

OBJECT OF THE INVENTION

The object of the present invention is to provide a capture mechanism for securely holding a dispensing spout of a flexible bag housed in a box in place in an external dispensing position beneath the base level of the box. It is a further object of the present invention to provide a unit for use in dispensing a liquid from a box housing a flexible bag containing liquid to be dispensed comprising a capture mechanism of the present invention and a box-supporting shelf adapted to accommodate the capture mechanism. It is a still further object of the present invention to provide a means to increase the speed of chill transfer to the fluid in the bag housed in the box. It is also an object of the present invention to provide a capture mechanism that facilitates the insertion of the box into a dispensing unit. It is a further object of the invention to provide a capture mechanism which easily interfaces with a dispensing unit.

SUMMARY OF THE INVENTION

According to one aspect of the present invention, there is provided a capture mechanism for a dispensing spout of a bag-in-box liquid dispenser, the dispenser adapted to enable said dispensing spout protrude through at least the base of its box, the capture mechanism comprising:

means for capturing a dispensing spout of a bag-in-box liquid dispenser, wherein in use with at least a portion of the capture mechanism cooperating with the box of a bag-in-box liquid dispenser adapted to enable its dispensing spout protrude through at least the base of its box, the capturing means is positioned to maintain the dispensing spout in a low dispensing position relative to the level of the base of the box.

The capture mechanism may further comprise a shelf for supporting at least a portion of the base of the box. The shelf may lie in a plane higher than that of the means for capturing so as to ensure the base of the box is held above the spout when captured. The shelf may therefore act as stop means to maintain the base of the box in a relatively high position.

The capture mechanism may further comprise means for abutting at least a portion of the front face of a box of a bag-in-box dispensor. The means for abutting may be substantially perpendicular to the shelf so as to form a roughly L-shaped corner into which the corner of the box may be accommodated. The shelf may be at an inclined angle to the base of the capture mechanism to as to angle the base of a box supported thereon, and tip it forward slightly. The capture mechanism may further comprise a well for accommodating a portion of the bag of a bag-in-box dispenser. The capture mechanism may comprise a block portion to securely accommodate the dispensing spout of a bag-in-box liquid dispenser. The block portion may comprise a coupling member for releasably engaging with a spout-receiving portion. The coupling member may be fully detachable from the spout-receiving portion. In addition/in contrast, the coupling member may be tethered to the spout-receiving portion. The coupling member and a co-operating section of the spout-receiving portion may comprise complementary male and female formations. At least one of said coupling member and said spout-receiving portion preferably comprises locking means. The locking means may be pivotally connected to either side of the coupling member and receivable into complimentary recesses in the spout receiving portion. The locking means may be released by squeezing their upper ends towards each other to release catches on the lower ends of each locking arm from corresponding catches within the complimentary recesses. Both the coupling member and the spout-receiving portion may be provided with a substantially U-shaped channel to engage about the gland of a spout to be captured.

According to a further aspect of the present invention there is provided a capture mechanism for a dispensing spout of a bag-in-box liquid dispenser, the dispenser adapted to enable said dispensing spout protrude through at least the base of the box, the capture mechanism comprising:

a platform adapted to co-operate with the base of a box of a bag-in-box liquid dispenser; and means for capturing a dispensing spout of a bag-in-box liquid dispenser, wherein in use with the platform mating with the box of a bag-in-box liquid dispenser adapted to enable its dispensing spout protrude through at least the base of its box, the capturing means lies in a plane beneath the platform to maintain the dispensing spout in a low dispensing position relative to the level of the base of the box.

One of the main advantages of the present invention is that the spout is kept in a low dispensing position, thereby negating the need to apply further manual force to the bag in the box to ensure that all the liquid has been dispensed therefrom.

Preferably, the spout is adapted to be dropped down to a low dispensing position such that the spout is positioned at a level under the base of the container in use. This provides a gravitational well to urge the liquid from the bag to be dispensed via said spout. It will be appreciated that the liquid flow rate is maximised through the funnelling of the liquid in the bag into a lower level "gravitational well", before dispensing from the lowest level of the spout. As the box once opened is inverted and the gravitational pressure of the liquid is directed downwards into the box and not outwards through the now open box. This then allows the extra material of the bag (portion of the bag attached to the spout) to be easily manoeuvred into place into the tap capture mechanism without having to contend with the pressure exerted by the liquid contained within the bag.

The capturing means may comprise a block to securely accommodate the dispensing spout of a bag-in-box liquid dispenser. The block may further comprise a locking means to releasably lock the capturing means to the platform. Preferably, the block comprises a coupling member for releasably engaging with a spout-receiving portion of the block. It is of course understood that the locking means of the coupling member and the co-operating section of the spout-receiving portion can comprise any locking means known to those skilled in the art other than male and female formations, for example, complementary threaded counterparts, fasteners, magnets, clips, and the like commonly used in the art.

In one embodiment, the coupling member is pivotally attached to the spout-receiving portion. In a further embodiment, the coupling member is fully detachable from the spout-receiving portion. In this format, it is simply a locking "block" which allows a tap to be captured easily when the liquid in the bag of a bag-in-box system is not pressing against the box opening. For each of the above embodiments, the coupling member and a co-operating section of the spout-receiving portion comprise complementary male and female formations.

In a further embodiment of the present invention, the block comprises a single unit having an open-sided internal channel configured to securely accommodate the dispensing spout. The block further comprises opposing jaws spaced-apart so as to provide an opening into the internal channel.

According to one embodiment of the invention, at least a portion of the platform is adapted to be received into an aperture in the base of a box of a bag-in-box dispenser. In an alternative embodiment, the platform may form part of a shelf for supporting a box on which a box sits.

It will also be appreciated that the platform may take different forms and shapes, and the level of cooperation between the base of the box and the platform may vary from only supporting the base or part of the base of the box to a more engaging contact wherein there becomes some level of inter-engagement between the two.

According to one embodiment of the invention, the platform is an integral part of the main body of the capture mechanism and take the form of shelf, which may be located behind the means for capturing on the box-facing side of the capture mechanism.

It is desirable that the platform comprises:

an elongated section extending distal of the capturing means to co-operate with the base of the box;

(i) a stepped ledge at a proximal end of the elongated section to clip onto the base of the box; and (ii) a flange at a distal end of the elongated section receivable into an aperture in the base of the box, the stepped ledge and flange adapted to operate in tandem to secure the platform to the base of the box.

A capture mechanism of the present invention may further comprise a recess in the platform or elsewhere to accommodate a portion of the bag attached to the dispensing spout protruding through at least the base of the box. The advantage of this recess is that it can accommodate a portion of the bag protruding through at least the base of the box, thereby assisting in maintaining the spout in a low dispensing position when engaged with the capture mechanism of the present invention. Further, the recess prevents the fluid-filled bag from bulging out of the bottom or front of the box (after the tear off portions of the box have been removed) when a user is trying to insert the box into a liquid dispenser.

In a further aspect of the present invention, the flange is adapted to be received into an aperture in the base of the box. The flange comprises a raised lip at a distal end of the elongated section.

In aspects of the present invention, it is desirable that each block or coupling member and spout-receiving portion comprise a substantially U-shaped channel. It will be appreciated however that the respective channels may take alternate forms to suit various shaped spouts/taps.

The present invention further provides a capture mechanism for a dispensing spout of a bag-in-box liquid dispenser, the dispenser adapted to enable said dispensing spout protrude through at least the base of its box, the capture mechanism comprising:

a shelf adapted to support at least a portion of the base of a box of a bag-in-box liquid dispenser; and means for capturing a dispensing spout of a bag-in-box liquid dispenser, wherein in use with the shelf supporting at least a portion of the box of a bag-in-box liquid dispenser adapted to enable its dispensing spout protrude through at least the base of its box, the capturing means lies in a plane beneath the shelf to maintain the dispensing spout in a low dispensing position relative to the level of the base of the box.

The capture mechanism may further comprise a stop means or abutments to engage the front face of the box. The capture mechanism may further comprise a well or cavity to accommodate a portion of the bag projecting from the opening of the box in use. Two or more parts of the capture mechanism may be tethered together using a flexible tether or security cord, wire or strap. A flexible tether may be used to prevent any of the cooperating parts from becoming lost or misappropriated. The flexible nature of the tether allows for full 360 degree movement of any tethered parts.

In a further aspect of the present invention, there is provided a unit for use in dispensing a liquid from a bag-in-box liquid dispenser, the dispenser adapted to enable a dispensing spout protrude through at least the base of the box, the unit comprising:

a capture mechanism according to present invention and as described above, and a box-supporting shelf adapted to accommodate the capture mechanism. It is preferable that the supporting shelf comprises:

an upper surface for supporting the base of a box, the upper surface having defined therein a cavity into which the capturing means of the capture mechanism is accommodatable. The supporting shelf may further comprise engagement means within the cavity to co-operate with at least one corresponding tab provided on said capturing means to releasably lock the capture mechanism to the supporting shelf.

Preferably, the releasable engagement means is selected from the group comprising a magnet, a clip, and complimentary engagement formations. It will be readily understood by those skilled in the art that any other engagement means may be used that are described in the common general knowledge and known in the art.

The supporting shelf may further comprise an actuator for releasing the capture mechanism from the releasable engagement means of the supporting shelf. This provides a convenient means for disengaging the capture mechanism from the unit in the event that all the liquid has been dispensed from the bag-in-box system and requires replacement.

The supporting shelf may further comprise a heat transfer contact plate to engage with a bag in a bag-in-box dispenser. The contact plate helps drive chilling into the exposed bag by virtue of the bag being in contact with the plate.

It should also be understood that platform may form an integral part of the supporting shelf. The platform may also co-operate with the heat transfer contact plate to further extend the contact plate by association with the platform into the actual box on the inner side, thus extending the surface chilling area. This arrangement greatly speeds up the liquid chilling process.

The advantages of the above-described unit is that the unit supports the body of the box after the tear off sections have been removed so as to prevent or minimise any bulging of the liquid in the bag out of the now exposed hole or holes in the box.

A further advantage of the present invention is that the unit allows capture of a tap when fluid is not pressing against the tap and then subsequent placement of the now captured tap into a separate dispensing unit without having to make further movements to engage the tap with the tap capture mechanism. The only engagement is by the capturing means (and not the tap itself) with the dispensing mechanism. The box—now attached to the tap capture mechanism—can easily be then inserted into a cooling shelf of the dispenser, with the tap capture mechanism now acting as a centring and locking mechanism to ensure that the box is properly aligned on the cooling surfaces of the heat transfer contact plate and that the tap capture mechanism (and hence the bag and box and tap) is easily centred into the correct dispensing position, with minimal further input from the user.

A further advantage of the present invention described above is that when in use, the tap capture mechanism extends into the box, contacts the heat transfer contact plate, and at the same time is in direct contact with the bag (the protective cardboard outer having been removed), thereby speeding up the heat transfer to chill the liquid in the bag and preventing the bag from bulging out of the box once the tear-off sections of the box have been removed.

BRIEF DESCRIPTION OF THE DRAWINGS

The invention will be more clearly understood from the following description of an embodiment thereof, given by way of example only, with reference to the accompanying drawings, in which:—

DETAILED DESCRIPTION OF THE DRAWINGS

It should be readily apparent to one of ordinary skill in the art that the embodiments disclosed herein below represent generalised embodiments only, and that other arrangements are possible and are embraced by the present invention.

Figure 1:
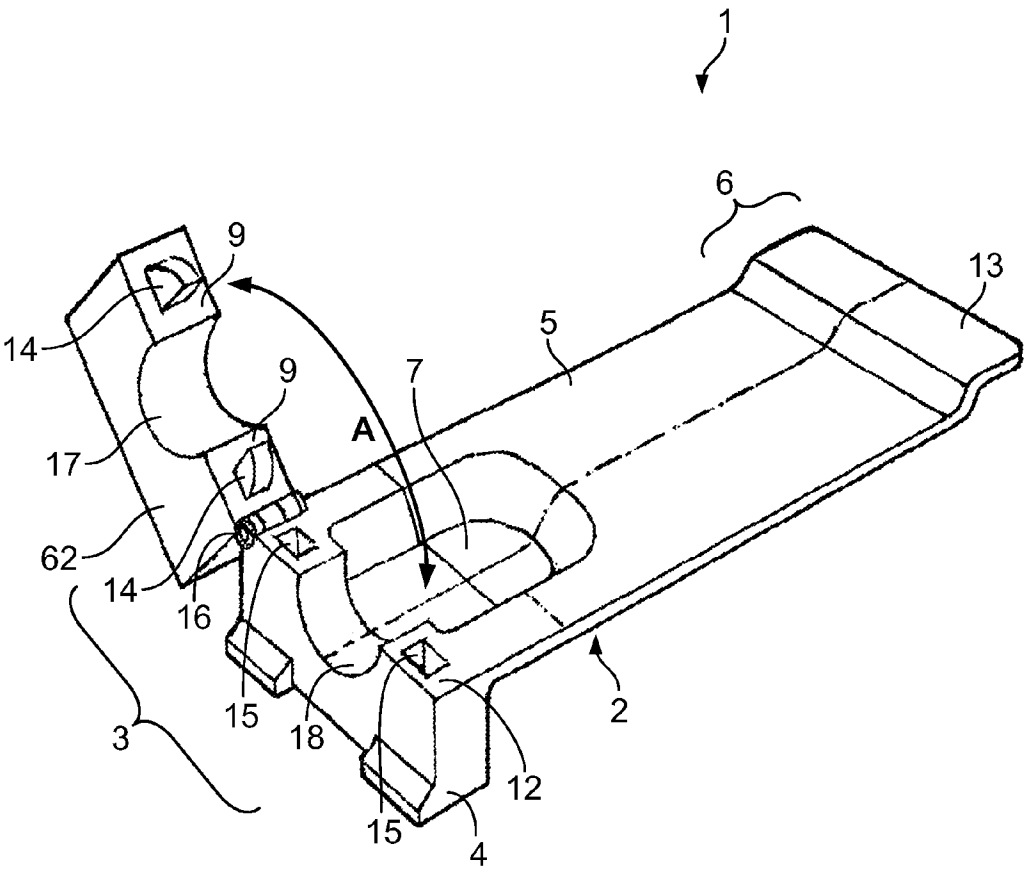
FIG. 1 illustrates a perspective view of a capture mechanism of the present invention.

In FIG. 1 there is illustrated a side view in cross section of a mechanism according to the present invention. The mechanism is for use with bag-in-box dispensing systems, which generally comprise a box having formed therein an opening near its base to allow a dispensing spout project from the box, and in some instances allow a portion of the bag to be substantially pulled through the opening provided therein, so that the spout projects substantially under the level of the base of said box in a low dispensing position. The mechanism is generally indicated by the reference numeral 1. The capture mechanism comprises a platform 2 and a capturing means 3. The platform 2 is adapted to engage with and support the base of the box, while the capturing means 3 releasably engages with the platform 2 to capture the spout 11 (see FIG. 2).

The capturing means 3 comprises a block 60 having a coupling member 62 and a spout-receiving portion 4, which is adapted to co-operate with the coupling member 62. The platform 2 comprises an elongated section 5 extending distal of the capturing means 3 and a flange 6 at the distal end of the elongated section 5. The spout-receiving portion 4 co-operates with the coupling member 62 by a co-operating section 12.

The platform 2 further comprises a recess 7 to accommodate the portion of the bag pulled out of the box in the spout's dispensing position.

The coupling member 62 further comprises a locking means 9. The coupling member 62 and spout-receiving portion 4 each comprise a substantially U-shaped channel 17,18 to engage with and accommodate a gland 21 in fluid communication with the spout 11 (see FIG. 2). Both the coupling member 62 and spout-receiving portion 4 comprise complementary male and female formations 14,15. In the current embodiment as illustrated in FIG. 1, the male formation 14 is shown on the coupling member 62, while the female formation 15 is shown on the spout-receiving portion 4. It should be understood by the skilled artisan that the placement of the male and female formations 14,15 on the coupling member 62 and spout-receiving portion 4 may be reversed. It should also be understood by the skilled artisan that the male and female formations 14,15 could take alternate forms in terms of shape and size.

As shown in the embodiment as illustrated in FIG. 1, the coupling member 62 is pivotally attached to the spout-receiving portion 4 by hinge 16. The coupling member 62 pivots about the hinge 16 in the direction of arrow A to engage with the co-operating section 12 of the spout-receiving section 4. The male and female formations 14,15 releasably engage with each other and the substantially U-shaped channels 17,18 accommodate and secure the gland 21 in fluid communication with the spout 11 of a bag-in-box system in the dispensing system (explained in more detail below, see FIGS. 5 and 6).

Figure 2:
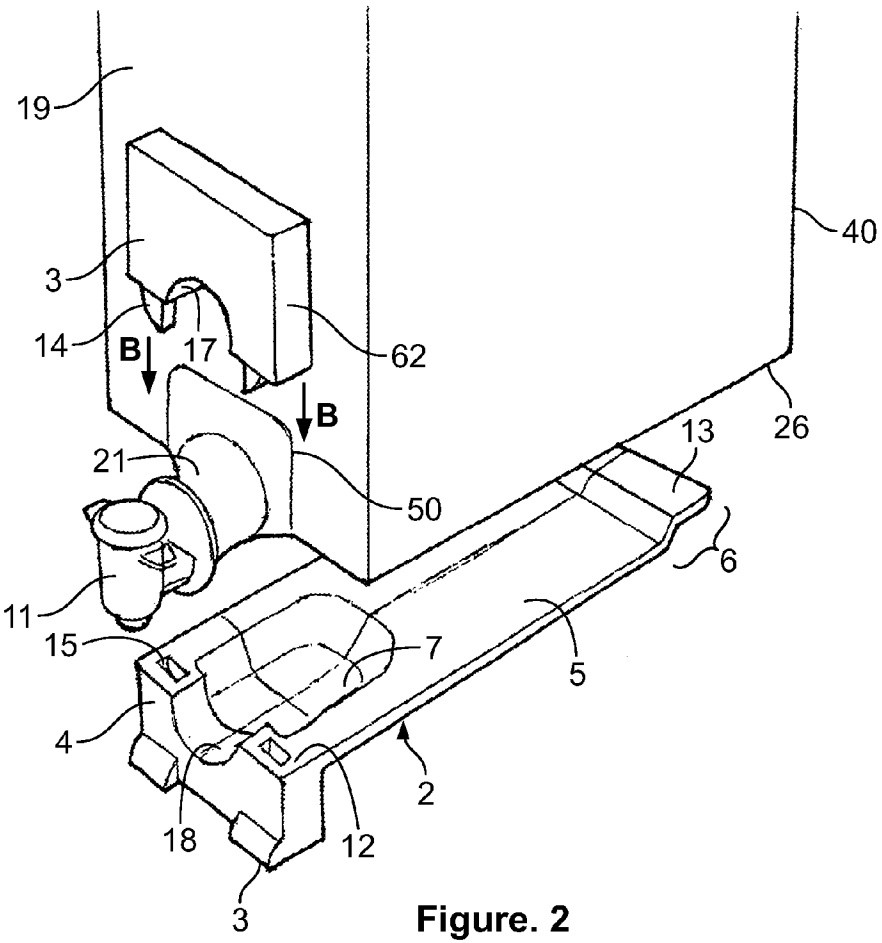
FIG. 2 illustrates a diagrammatic representation of a perspective view of an alternative embodiment of the capture mechanism of the present invention engaging a bag-in-box system.

As illustrated in FIG. 2, there is shown an alternative embodiment of the present invention where the coupling member 62 is fully detachable from the capturing means 3. In use, the coupling member 62 is placed against a front face of a box 19 of a bag-in-box system, with the spout 11 in a low dispensing position through an aperture 50. The coupling member 62 is moved in the direction of arrow B to releasably engage with the co-operating portion 12 of the capturing means 3. When the coupling member 62 and spout-receiving portion 4 have engaged, the gland 21 of the spout 11 is secured within the substantially U-shaped channels 17,18, ensuring that the spout 11 is secured in a low dispensing position.

In an alternative embodiment, a universal gland capturing saddle (not shown) may be reversibly secured either around the gland 21 or within the substantially U-shaped channels 17,18. The universal gland capturing saddle can adapt to the shape and/or size of any gland used in bag-in-box systems, such as gland 21 as shown in FIG. 2. In a further alternative embodiment of the present invention, the block 60 comprises a single unit having an open-sided internal channel configured to securely accommodate the dispensing spout. The block comprises opposing jaws spaced apart so as to provide an opening into the internal channel. It is advantageous to have the jaws biased closely together at rest but moveable apart to increase the opening into the internal channel. The opening provides a means by which the block 60 can be pushed over the gland 21, to force the gland 21 into the internal channel, wherein it is securely engaged. When the block 60 is pushed over the gland 21 and the gland secured within the internal channel, the jaws return to their original biased closed/nearly closed position trapping the gland within the block.

Figure 3:
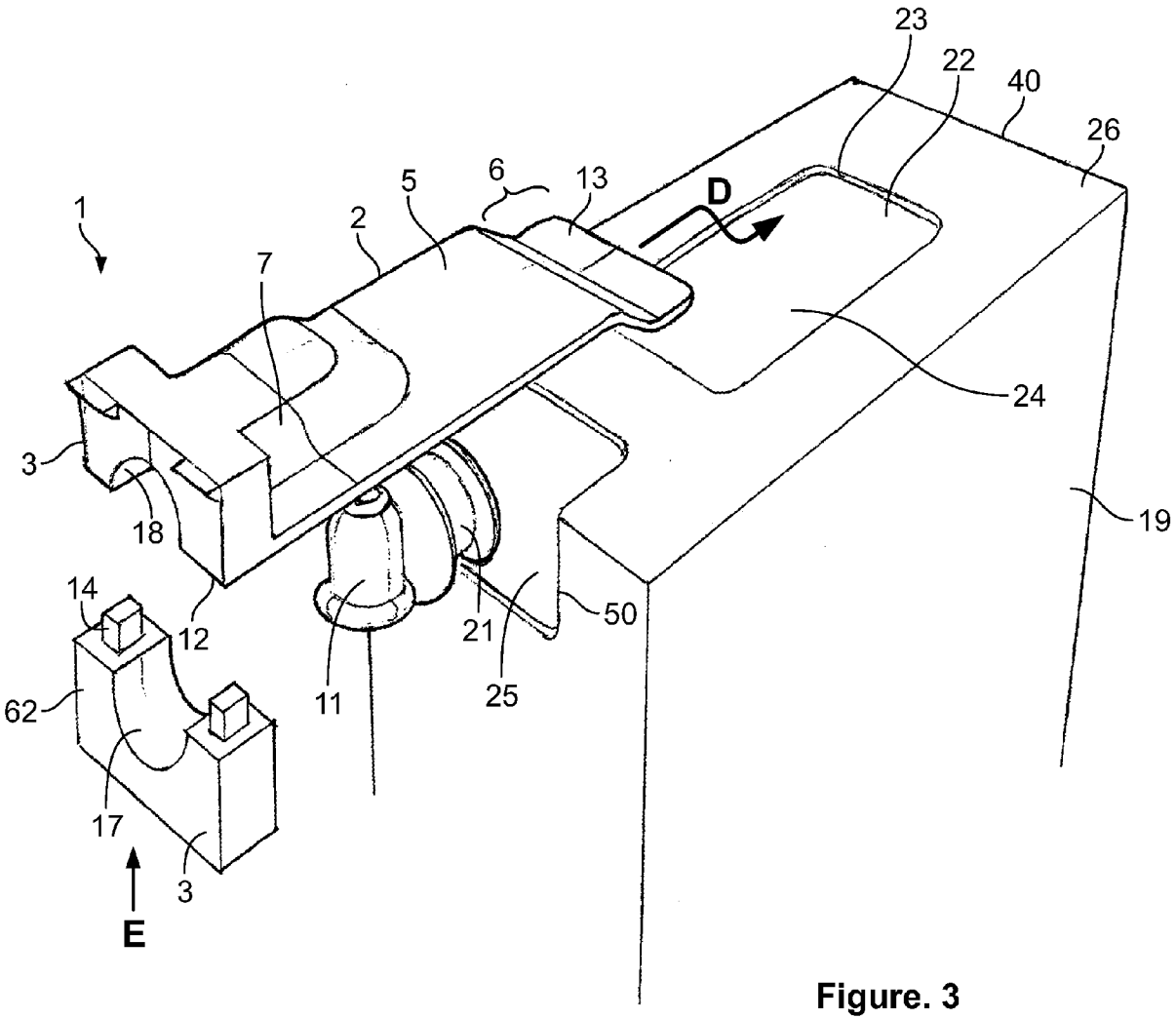
FIG. 3 illustrates a diagrammatic representation of an underside view of an embodiment of the capture mechanism of the present invention engaging a bag-in-box system.
Figure 7:
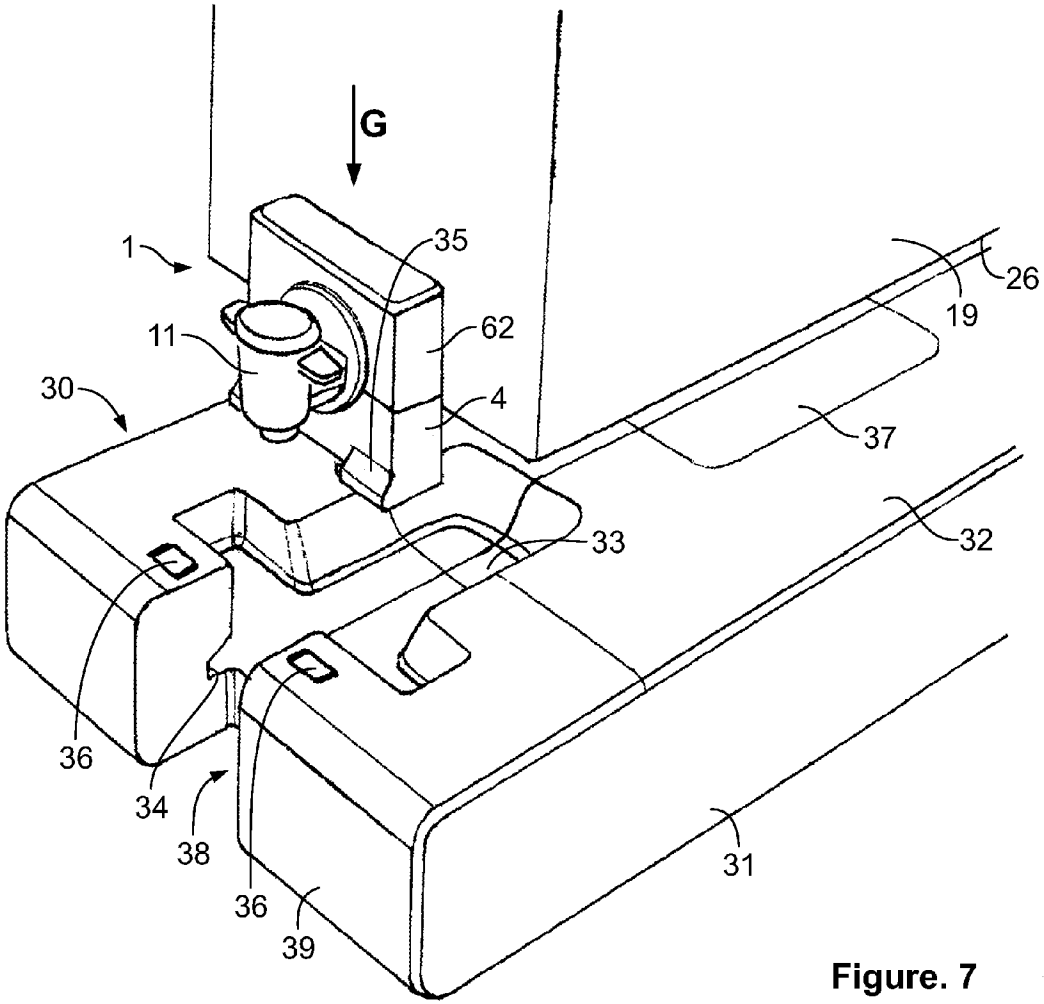
FIG. 7 illustrates a perspective view of a unit comprising a capture mechanism of the subject invention engaged with a bag-in-box system.

FIG. 3 shows the underside of the arrangement shown in FIG. 2, wherein it can be seen that the box 19, for which this embodiment of capture mechanism is designed for use with, is provided with a second aperture 22 in its base 26. The primary purpose of this second aperture 22 is to gain access to the bag inside the box 19. Access to the internal bag is desirable to enable a heat transfer contact plate to be brought into direct contact with the bag to cool the liquid contained therein. In prior art arrangements, the box may be placed directly on a cooling shelf or plate however this is undesirable as the weight of the liquid in the bag can force the bag to bulge out through the aperture in the base of the box. This problem is overcome by the elongate section 5 of the platform 2 of the capture mechanism shown in FIGS. 1 to 3. As shown in FIG. 7, the elongated section 5 of the platform 2 is adapted to cover the box's base aperture 22 to prevent the bag from protruding out through the aperture. Cooling of the bag is then affected via the platform 2. The weight of the liquid in the bag will maintain direct and close contact between the bag and the upper face of the section of the platform 2 covering aperture 22. The underside of this section of the platform 2 can then be brought into direct contact with a heat transfer contact plate or shelf.

A flange 6 is provided at the distal end of the elongated section 5 to maintain and secure the platform 2 against the base of the box against the gravitational pressure of the fluid-filled bag. In use, flange 6 is tucked inside aperture 22 as shown by arrow D in FIG. 3. Flange 6 comprises a raised lip portion 13 that is adapted to engage with the interior back wall 40 of the box.

Figure 4:
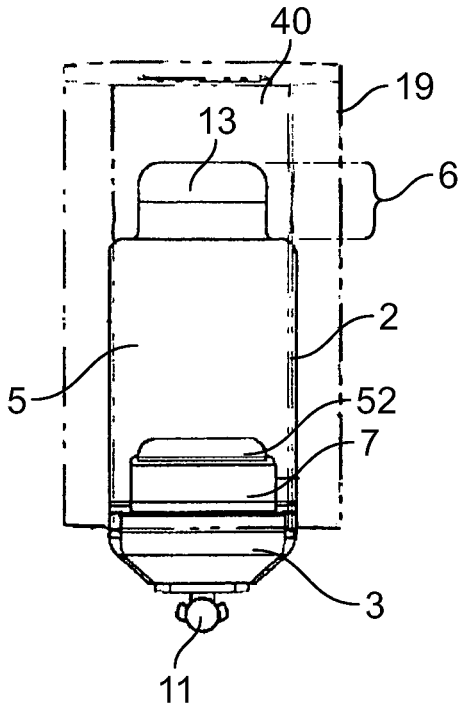
FIG. 4 illustrates a top view representation of a further embodiment of the capture mechanism of the present invention engaging a bag-in-box.
Figure 5:
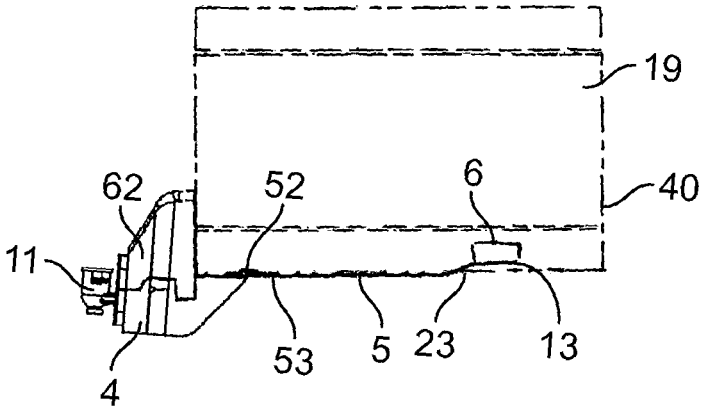
FIG. 5 illustrates a side view of the capture mechanism of FIG. 4.

The platform 2 further comprises a stepped ledge 52 configured to engage with aperture 50 provided to allow a portion 25 of a bag 24 to be pulled through the opening of the box 19 prior to engaging the mechanism 1 with the bag-in-box system, as illustrated in FIGS. 4 and 5. In use, when the platform 2 is received in the apertures 50,22 of the box 19, the stepped ledge 52 rests on an edge 53 of the aperture 50 inside the base 26 to secure the platform 2 inside the box 19.

FIG. 3 also illustrates by way of example the steps by which the capture mechanism 1 of the present invention may engage with a bag-in-box system. For instance, the first step is where, when the box 19 is positioned so that the base 26 of the box 19 is facing upwards to a user, the platform 2 of the mechanism 1 engages with the apertures 22,50 in the base 26 of the box 19. The platform 2 engages with the base 26 of the box 19 via raised lip 13 of flange 6. The raised lip 13 is inserted into the base 26 via aperture 22 in the direction of arrow D. The raised lip 13 slips through the aperture 22 and rests on an edge 23 of the aperture 22 inside the base 26 and abuts against the back wall 40 of box 19. The stepped ledge 52 rests on the edge 53 of the aperture 50 (see FIGS. 4 and 5). A portion of the elongated section 5 of the platform 2 and the box engaging means 6 are in contact with the bag 24 accommodated within the box 19. The contact between the bag 24, elongated section 5, and engaging means 6 prevent the bag 24 from bulging and protruding through aperture 22 of box 19. When the platform 2 is in an engaged position with apertures 22,50, the gland 21 of the spout 11 is accommodated within the substantially U-shaped channel 18 of the spout-receiving portion 4, and the portion 25 of the bag 24 is accommodated in the recess 7 (not shown—see FIG. 8). The portion 25 is pulled through the opening of the box 19 prior to engaging the mechanism 1 with the bag-in-box system.

The second step is to secure the spout 11 in a low dispensing position by positioning the coupling member 62 over the gland 21 of the spout 11 and moving the coupling member 62 in the direction of arrow E. The male and female formations 14,15 on the coupling member 62 and co-operating portion 12 engage, thereby locking the coupling member 62 and capturing means 3 together. The spout 11 is now secured in a low dispensing position.

In an alternative embodiment, a universal saddle (not shown) can also be used in conjunction with coupling member 62 and spout-receiving portion 4 to secure the spout 11 in a low dispensing position as explained above. The universal saddle is configured to adapt to any shape and/or size of gland 21 used in the prior art bag-in-box systems, as explained above.

Figure 6:
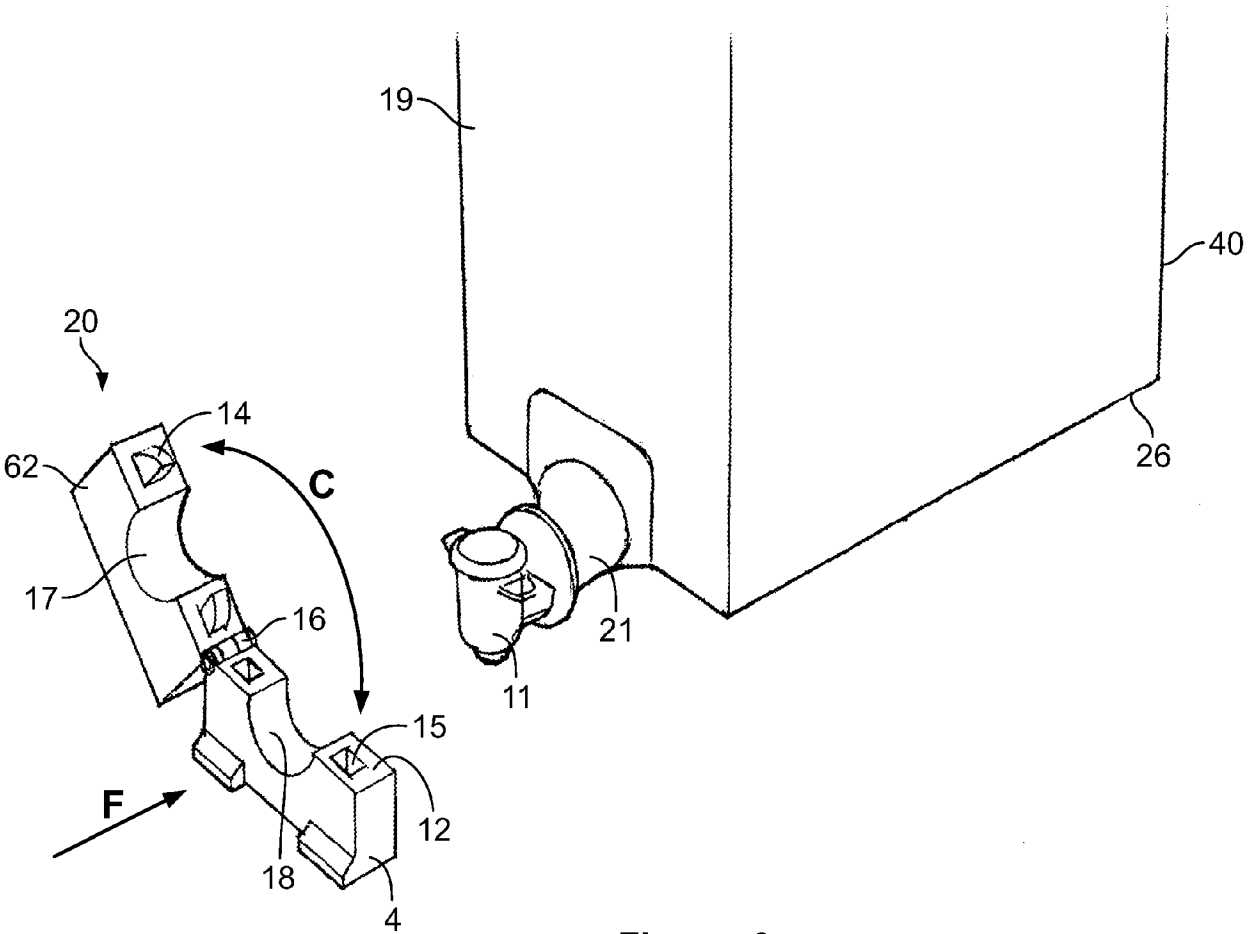
FIG. 6 illustrates a perspective view of a further alternative embodiment of the capture mechanism of the present invention.

As illustrated in FIG. 6, there is shown a further alternative embodiment of a capture mechanism of the present invention, generally indicated by reference numeral 20, wherein the coupling member 62 is pivotally attached to the spout-receiving portion 4 by hinge 16. In this embodiment, the spout-receiving portion 4 is not attached to a platform. As such, the capture mechanism 20 of FIG. 6 does not engage with the base of the box due to the lack of a platform, but instead engages with the spout 11 of a bag-in-box system. The coupling member 62 pivotally moves in an arc, as indicated by arrow C, to releasably engage with the spout-receiving portion 4. When in use, the capture mechanism 20 is moved toward the spout 11 in the direction of arrow F when in a disengaged state. The coupling member 62 is pivoted about hinge 16 in the direction of arrow C, engaging with the gland 21 of the spout 11, and releasably co-operating with co-operating portion 12 of the spout-receiving portion 4. The male and female formations 14,15 of the capture mechanism 20 engage, thereby securing the spout 11 in a low dispensing position.

In an alternative embodiment, a universal saddle (not shown) can also be used in conjunction with the capture mechanism 20 to secure the spout 11 in a low dispensing position as explained above. The universal saddle is configured to adapt to any shape and/or size of gland 21 used in the prior art bag-in-box systems, as explained above. In a still further embodiment, the coupling member 3/spout-receiving portion 4 of FIGS. 1 to 5 and capture mechanism 20 of FIG. 6 can each be comprised of a single block (not shown) having a substantially circular open sided internal channel configured to securely accommodate the gland 21 of the spout 11. The block comprises opposing jaws spaced apart so as to provide an opening into the internal channel. It is advantageous to have the jaws biased closely together at rest but moveable apart to increase the opening into the internal channel. The opening provides a means by which the unit can be pushed over the gland 21, to force the gland 21 into the internal channel, wherein it is securely engaged. When the block is pushed over the gland 21 and the gland secured within the internal channel, the jaws return to their original biased closed/nearly closed position trapping the gland within the block.

In FIG. 7, there is illustrated a unit for use in dispensing a liquid from the box 19 containing a liquid to be dispensed, the unit generally indicated by reference numeral 30. There is shown the mechanism 1 engaged with the gland 21 of the spout 11 and a box-supporting shelf 31 adapted to accommodate the mechanism 1. The box-supporting shelf 31 comprises an upper surface 32 for supporting the base 26 of the box 19. The upper surface 32 comprises a cavity 33 into which the capturing means 3 is accommodatable. The upper surface 32 further comprises an engagement means 34 within the cavity 33 which co-operates with at least one corresponding tab 35 provided on the capturing means 3. The tab 35 and engagement means 34 releasably lock the mechanism 1 to the box-supporting shelf 31.

The engagement means 34 may be selected from the group comprising a magnet, a clip, complimentary engagement formations, and the like known to those skilled in the art to provide a releasable engagement means.

The mechanism 1 engaged with a bag-in-box system is positioned into the cavity 33 of the supporting shelf 31 in the direction of arrow G. The tab 35 engages with the engagement means 34. The mechanism 1 can be released from the engagement means 34 of the supporting shelf 31 by activating an actuator 36 provided on the supporting shelf 31.

In a further embodiment, there is provided a heat transfer contact plate 37 on the upper surface 32 of the supporting shelf 31. When used with a capture mechanism without a platform 2, the heat transfer contact plate 37 is positioned to engage with the surface of the bag 24 through box aperture 22 to allow heat transfer to chill the bag 24, and ultimately the liquid stored in the bag 24. The contact plate 37 further provides additional support to the bag in the box and further acts to stop the bag bulging out of the box once the tear off sections are removed.

Alternatively, when being used with one of the platform-based embodiments of the capture mechanism of the present invention, the heat transfer contact plate 37 contacts the platform 2 engaged with the aperture 22 in the base 26 of the box 19 and the bag 24 accommodated therein. The platform 2 may be comprised of any thermally conductive material known to those skilled in the art, for example aluminium, to facilitate heat transfer from the heat transfer contact plate 37 to the liquid contained in the bag 24. As such, the liquid contained in the bag 24 is cooled rapidly.

Figure 8:
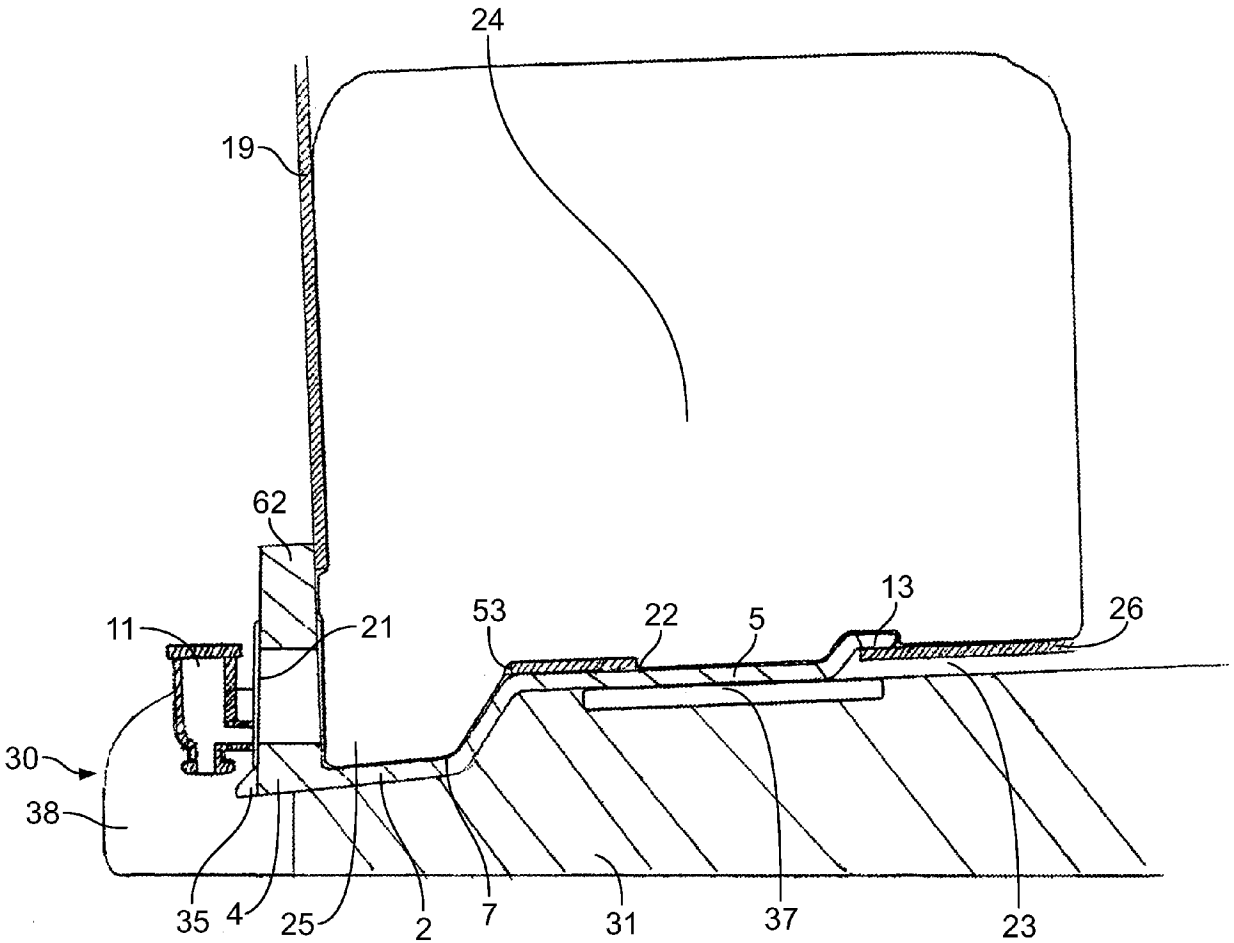
FIG. 8 illustrates a side view in cross-section of the capture mechanism of any of FIGS. 1 to 3 when engaged with a liquid dispensing unit.
Figure 9:
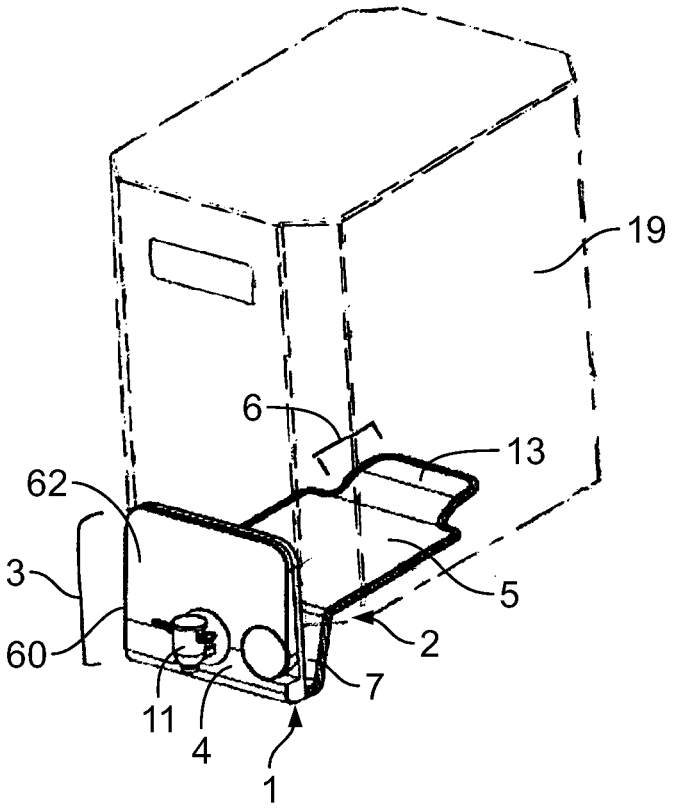
FIG. 9 illustrates a perspective view of a further alternative embodiment of the capture mechanism of the present invention when engaging a bag-in-box system.

When the mechanism 1 is engaged with the unit 30, there is an opening 38 at a front face 39 of the shelf 31 to allow a user access to the liquid dispensed from the spout 11. In FIG. 8 there is illustrated a cross section view of the mechanism 1 engaged with the spout 11 of a bag-in-box system and accommodated in the unit 30. The positioning of the portion 25 of the bag 24 in recess 7 is clearly illustrated in said Figure. Furthermore, the positioning of the mechanism 1 in the unit 30 is also more clearly illustrated, and how the raised lip 13 engages with the lip 23 in the base 26 of the box 19. As can be further seen in FIG. 8, contact plate 37 contacts the elongated section 5 of the platform 2, and heat transfer occurs, thereby chilling the liquid in the bag 24.

In FIGS. 9 to 12 there is illustrated an alternative embodiment of the present invention. The illustrated embodiment is a slim-line version of the capture mechanism described above, and reference numerals used above are also used here to annotate the various features of the mechanism. The illustrated embodiment is suitable for use in automatic dispensing units. The capture mechanism comprises a platform 2 and a capturing means 3. The platform 2 is adapted to engage with and support the base of the box, while the capturing means 3 releasably engages with the platform 2 to capture the spout 11 (as described for FIG. 2).

The capturing means 3 comprises a block 60 having a coupling member 62 and a spout-receiving portion 4, which is adapted to co-operate with the coupling member 62. In the current embodiment, the coupling member 62 and spout-receiving portion 4 are slimmer in construction than the capture mechanism described above for FIGS. 1 to 8. The platform 2 comprises an elongated section 5 extending distal of the capturing means 3 and a flange 6 at the distal end of the elongated section 5. The spout-receiving portion 4 co-operates with the coupling member 62 by a co-operating section 12 (not shown).

The platform 2 further comprises a recess 7 to accommodate the portion of the bag pulled out of the box in the spout's dispensing position.

The coupling member 62 further comprises a locking means 9 (not shown). Both the coupling member 62 and spout-receiving portion 4 comprise complementary male and female formations (not shown).

Figure 10:
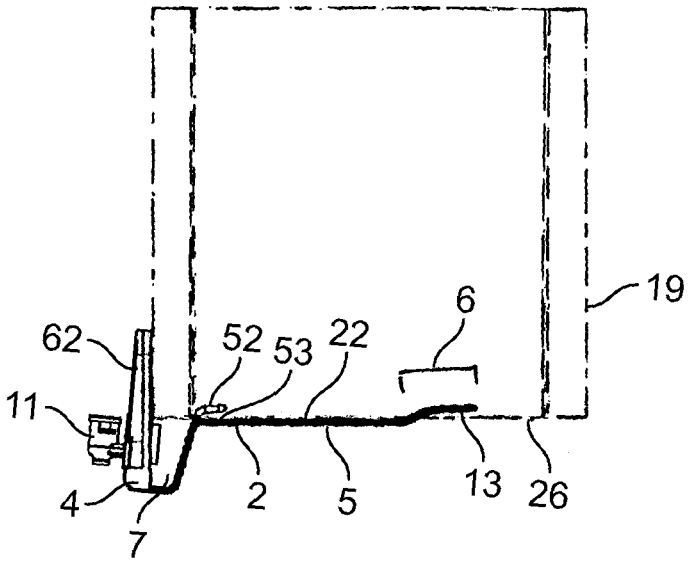
FIG. 10 illustrates a side view representation of the capture mechanism of FIG. 9.
Figure 11:
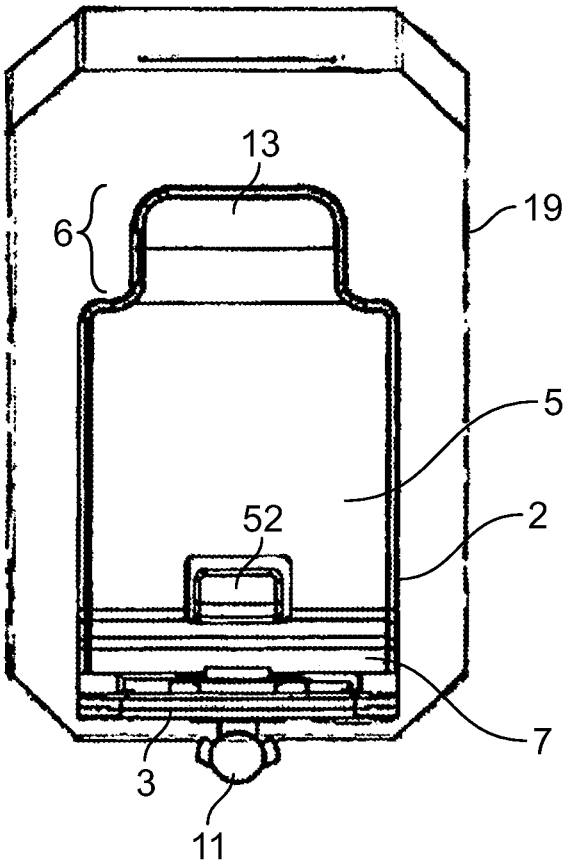
FIG. 11 illustrates a top view representation of the capture mechanism of FIG. 9.
Figure 12:
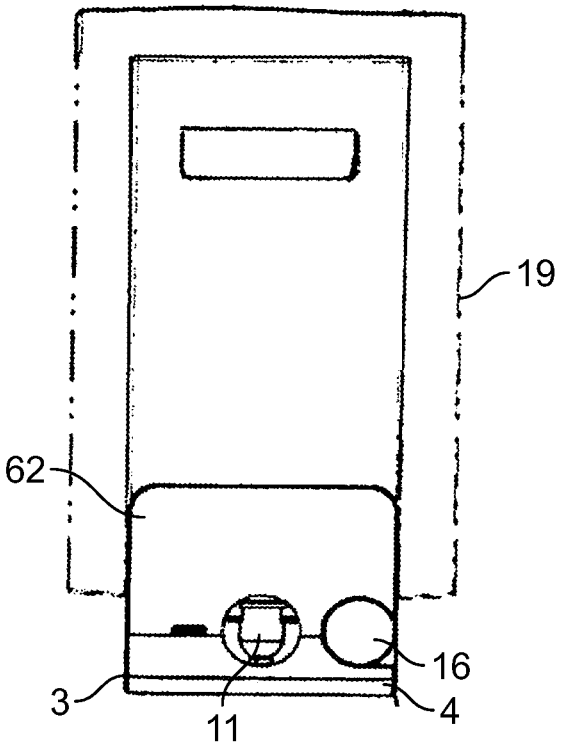
FIG. 12 illustrates a front view representation of the capture mechanism of FIG. 9.

In the embodiment as illustrated in FIGS. 9 to 12, the coupling member 62 is pivotally attached to the spout-receiving portion 4 by hinge 16. As shown in FIG. 10 the elongated section 5 of the platform 2 is adapted to cover the box's base aperture 22 to prevent the bag from protruding out through the aperture. Cooling of the bag is then affected via the platform 2. The weight of the liquid in the bag will maintain direct and close contact between the bag and the upper face of the section of the platform 2 covering aperture 22. The underside of this section of the platform 2 can then be brought into direct contact with a heat transfer contact plate or shelf.

A flange 6 is provided at the distal end of the elongated section 5 to maintain and secure the platform 2 against the base of the box against the gravitational pressure of the fluid-filled bag. In use, flange 6 is tucked inside aperture 22. Flange 6 comprises a raised lip portion 13 that is adapted to engage with the interior back wall 40 of the box. The platform 2 further comprises a stepped ledge 52 configured to engage with aperture 50 provided to allow a portion 25 of a bag 24 to be pulled through the opening of the box 19 prior to engaging the mechanism 1 with the bag-in-box system, as illustrated in FIGS. 4 and 5. In use, when the platform 2 is received in the apertures 50,22 of the box 19, the stepped ledge 52 rests on an edge 53 of the aperture 50 inside the base 26 to secure the platform 2 inside the box 19.

In FIGS. 13 to 16 there is illustrated an exploded perspective view of a mechanism according to a further embodiment of the present invention. The mechanism is for use with the aforementioned bag-in-box dispensing systems. The mechanism is generally indicated by the reference numeral 101. The capture mechanism comprises a tap capture base 102 and a coupling member 103. The tap capture base 102 is adapted to engage with and support the base of the box, while the coupling member 103 releasably engages with the base 102 to capture the spout (not shown).

The coupling member 103 comprises a block 105 having a substantially U-shaped channel 104 to engage with and accommodate a gland in fluid communication with the spout (not shown). The gland is the portion of the bag to which the bag's dispensing spout is attached. The coupling member 103 co-operates with the base 102 by a co-operating section 106. A tether 170 is provided between coupling member 103 and base 102. The tether 170 is flexible and may be a plastic wire, cable tie or similar and prevents the coupling member being lost or misappropriated. The flexible nature of the tether 170 allows for the full 360 degree movement of the respective parts of the tap capture mechanism (as against just a "hinged" up and down movement) thus making the actual placement and capture of the gland easier in the tap capture mechanism. Such a tether may be provided on any of the aforementioned embodiments of capture mechanism of the present invention between any two or more cooperating or associated parts.

Figure 13:
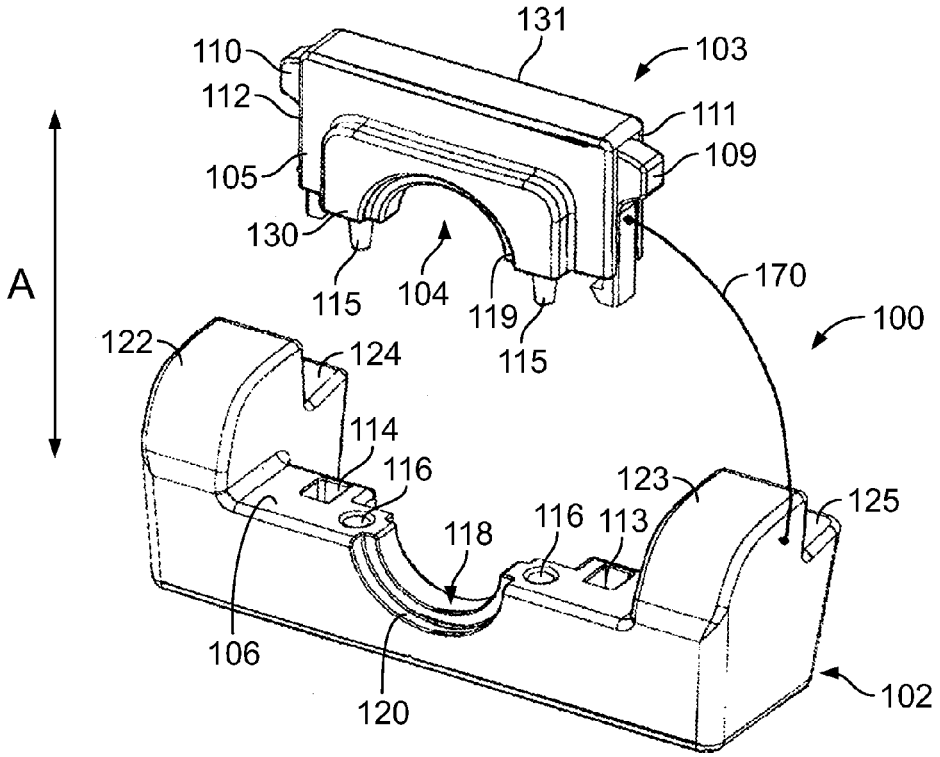
FIG. 13 illustrates an exploded perspective view of a capture mechanism of the present invention.

The coupling member 103 further comprises a locking means 109, 110. The locking means 109, 110 is pivotally connected at sides 111, 112 of the coupling member 103. The co-operating section 106 comprises corresponding formations 113,114 which accommodate the locking means 109, 110. The formations 113,114 may be configured to a snap-fit configuration. Both the coupling member 103 and co-operating section 106 comprise complementary male and female formations 115,116. In the current embodiment as illustrated in FIG. 13, the male formation 115 is shown on the coupling member 103, while the female formation 116 is shown on the co-operating section 106. It should be understood by the skilled artisan that the placement of the male and female formations 115,116 on the coupling member 103 and co-operating section 106 may be reversed. It should also be understood by the skilled artisan that the male and female formations 115,116 could take alternate forms in terms of shape and size. The male and female formations 115,116 act as guides to ensure that the coupling member 103 and base 102 are in the correct orientation when securing the spout substantially under the level of the base of the box in a low dispensing position. The co-operating portion 106 further comprises a substantially U-shaped channel 18 to engage with and accommodate the bag's gland. The substantially U-shaped channels 104,118 further comprise stepped ridges 119, 120 to further accommodate the spout of the bag of the bag-in-box system.

In use, the coupling member 103 is placed against a front face of a box of a bag-in-box system, with the spout in a low dispensing position through an aperture in the base of the box. The coupling member 103 is moved in the direction of arrow A to releasably engage with the co-operating portion 106 of the base 102. When the coupling member 103 and co-operating portion 106 have engaged, the gland of the spout is secured resting within the substantially circular aperture formed by U-shaped channels 104 and 118. The neck of the spout protruding thought the aperture in the closed capture mechanism is then additionally supported by stepped ridges 119, 120 ensuring that the spout 111 is secured and maintained in a low and static dispensing position.

In an alternative embodiment, a universal gland capturing saddle (not shown) may be reversibly secured either around the gland or within the substantially U-shaped channels 104, 118. The universal gland capturing saddle can adapt to the shape and/or size of any gland used in bag-in-box systems.

The base 102 further comprises a pair of stops 122,123 and shelves 124,125 juxtapositioned the co-operating portion 106. In use, the stops 122,123 and shelves 124,125 project inwardly (in a direction towards the box) from the co-operating portion 106. It will be appreciated that the shelves 124, 125 function as the platform as they support and hence cooperate with the base of the box in use. The shelves act to support and maintain the base of the box at a height above the dispensing spout when captured between base 102 and coupling member 103. The stops 122, 123 abut the front face of the box, not only to support same, but also to maintain the box a sufficient distance from the spout when captured to ensure ample room for the portion of bag rear of the spout to project freely out of the box.

Figure 14:
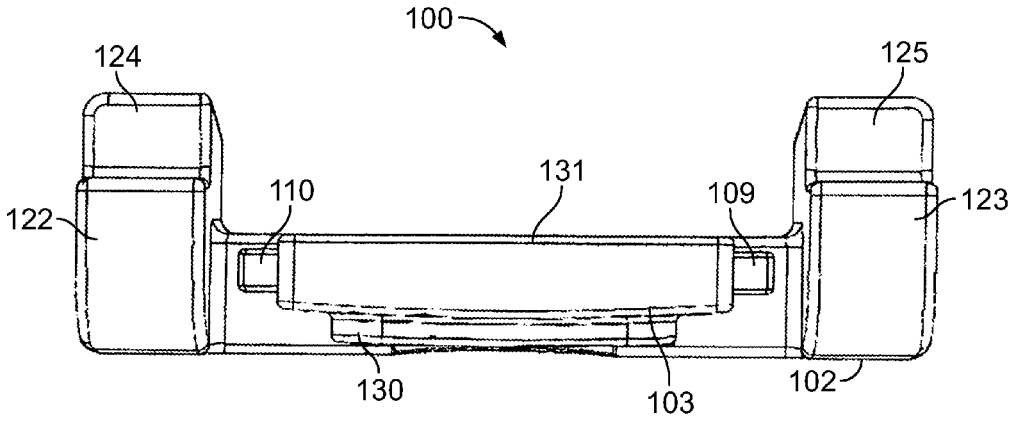
FIG. 14 illustrates a top plan view of the capture mechanism of FIG. 13.
Figure 15:
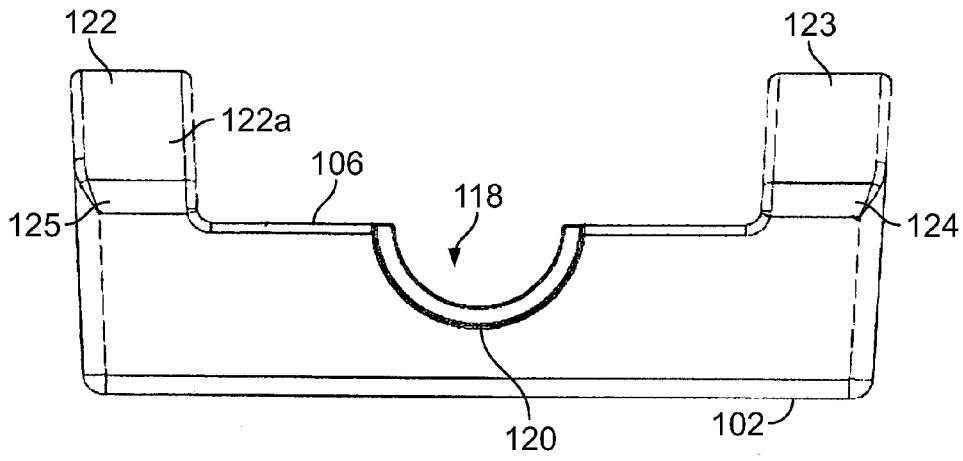
FIG. 15A illustrates a front view representation of one piece of the capture mechanism of FIG. 13.
FIG. 15B illustrates a side view representation of FIG. 15A.
Figure 15:
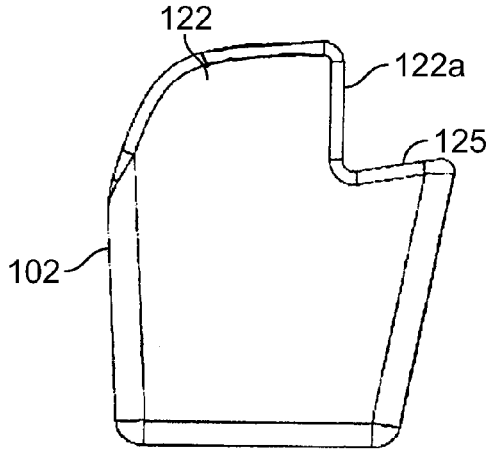
Figure 16:
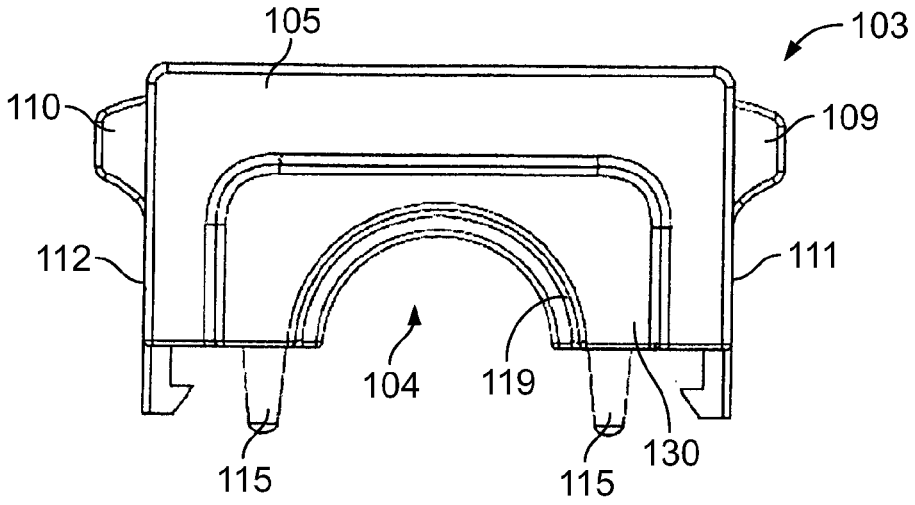
FIG. 16A illustrates a front view of a further piece of the capture mechanism of the FIG. 13.
FIG. 16B illustrates a side view representation of FIG. 16A.
Figure 16:
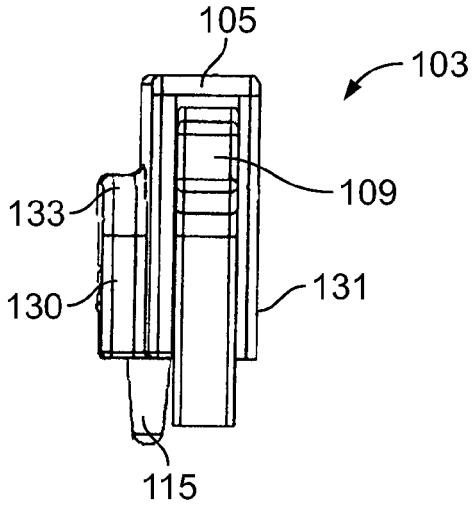

FIG. 14 shows the top view of the coupling member 103/base 102 combination. The coupling member 103 is shown having a front face 130 and back face 131. When engaged with the base 102, the coupling member 103 lies flush against the co-operating portion 106 and remains within the boundary edge of the co-operating portion 106. The stops 122,123 and shelves 124,125 are located on side wings of the base 102, the side wings extending rearwardly (towards the box when in use) from the back face 131 of the central portion of the coupling member 103.

FIGS. 15A and 15B show the front and side views, respectively, of the base 102. As shown in FIG. 15B, shelf 125 and the rear face 122*a* of stop 122 define a ledge to receive the lower front edge of the box. As shown in FIG. 15A, it is preferable that shelf 125 is inclined relative to the base of base 102. This results in an acute angle between shelf 125 and face 122*a*. Such an incline aids to support the box in a tilted orientation, wherein the base of the box is lower at its leading/front edge than at its rear. This aids to facilitate complete emptying of the liquid being dispensed.

FIGS. 16A and 16B show the front and side views, respectively, of the coupling member 103. As illustrated in FIG. 16B, the block 105 comprises a front face 130 and back face 131. The front face 130 comprises an arched collar or archway 133 which engages with the gland of the bag of a bag-in-box system. The archway 133 is clearly illustrated in FIG. 16A. The archway 133 comprises the substantially U-shaped channel 104 and stepped ridge 119.

Figure 17:
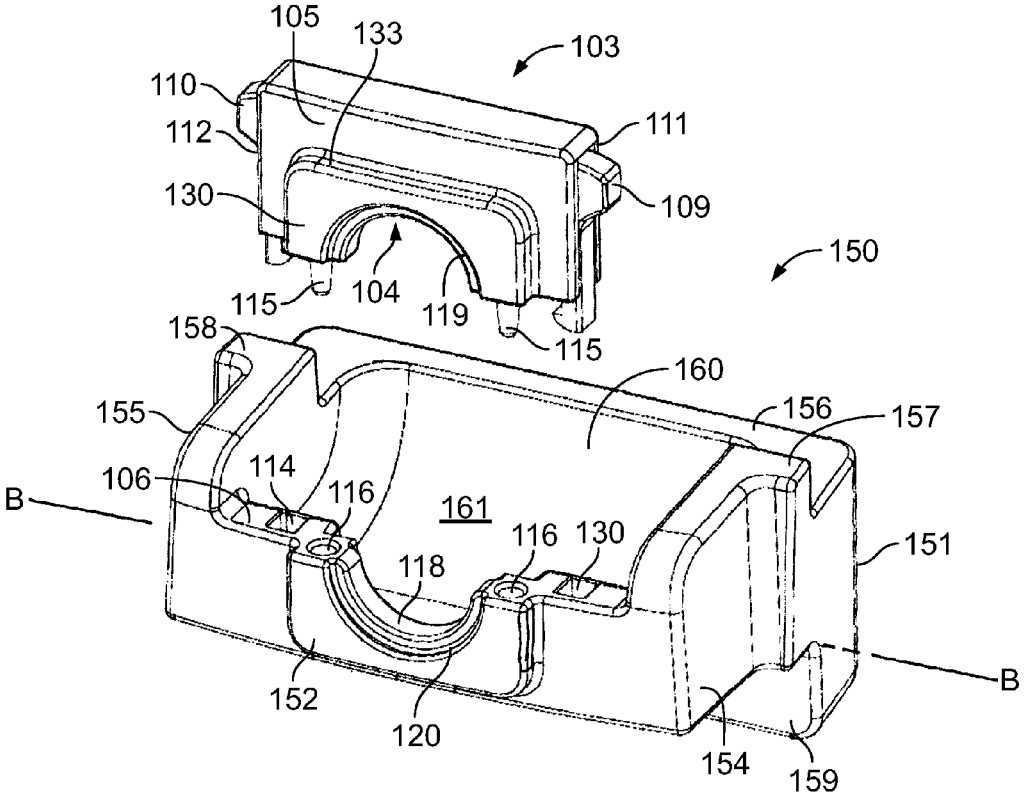
FIG. 17 illustrates an exploded perspective view of an alternative embodiment of the capture mechanism of the present invention.
Figure 18:
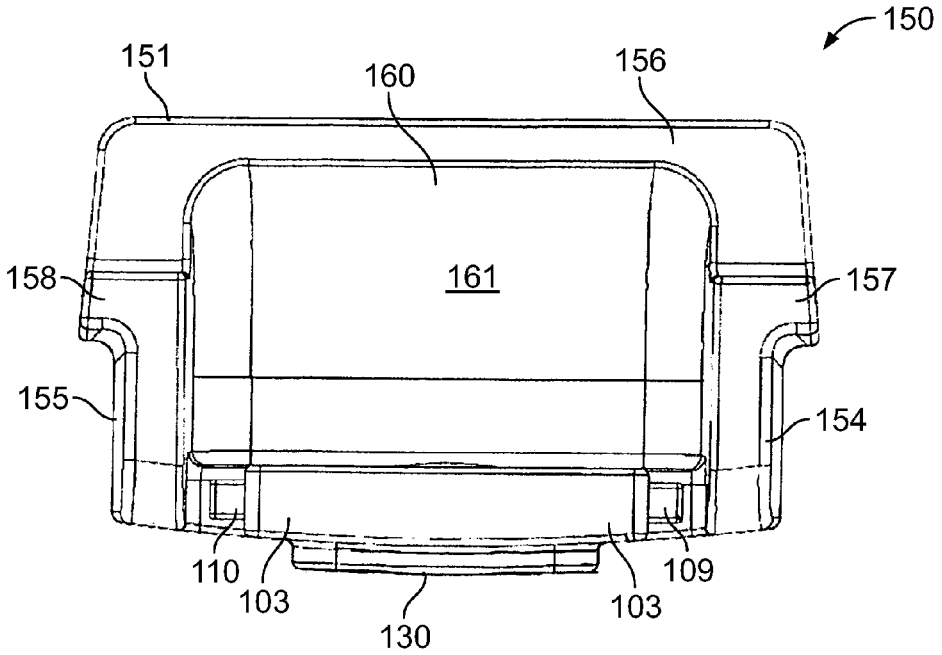
FIG. 18 illustrates a top view representation of the alternative illustrated in FIG. 17.
Figure 19:
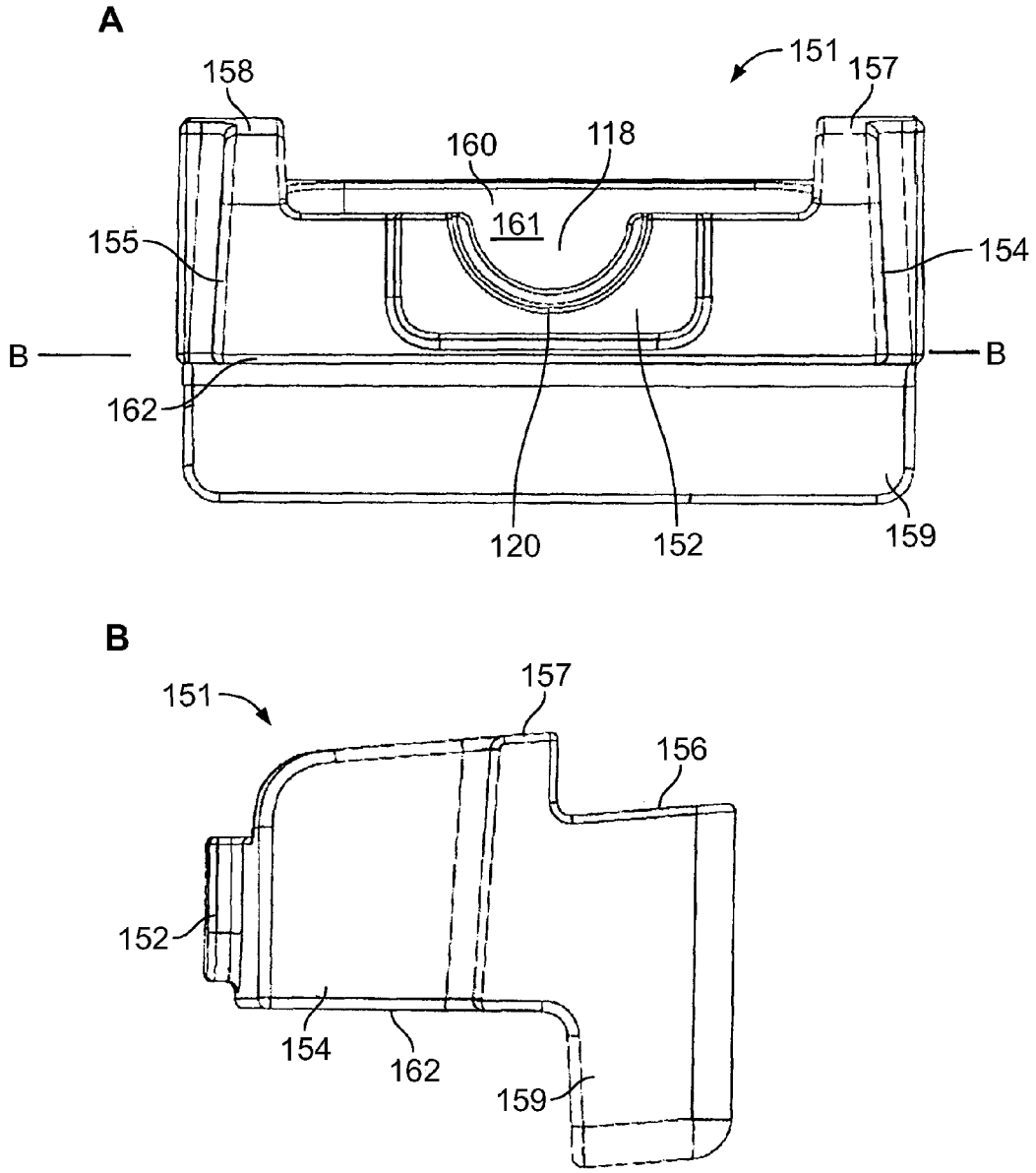
FIG. 19A illustrates a front view representation of one piece of the capture mechanism of FIG. 17.
FIG. 19B illustrates a side view representation of the piece of the capture mechanism of FIG. 19A.

As illustrated in FIGS. 17 to 19, there is shown a further alternative embodiment of a capture mechanism of the present invention, generally indicated by reference numeral 150. In this embodiment, the coupling member 103 is the same as that described for FIGS. 13 to 16 using the same reference numerals as used therein, and the tap capture base is generally indicated by reference numeral 151. Although not shown in these figures, parts 103 and 151 may be tethered together by a tether as per the previous embodiment described above. The base 151 comprises co-operating portion 106 as described above, that is, having corresponding formations 113,114 which accommodate the locking means 109,110 of the coupling member 103. The formations 113,114 may be configured to a snap-fit configuration. Both the coupling member 103 and co-operating section 106 of the base 151 comprise complementary male and female formations 115, 116, respectively. In the current embodiment as illustrated in FIG. 17, the male formation 115 is shown on the coupling member 103, while the female formation 116 is shown on the co-operating section 106. It should be understood by the skilled artisan that the placement of the male and female formations 115,116 on the coupling member 103 and co-operating section 106 may be reversed. It should also be understood by the skilled artisan that the male and female formations 115,116 could take alternate forms in terms of shape and size. The male and female formations 115,116 act as guides to ensure that the coupling member 103 and base 151 are in the correct orientation when securing the spout substantially under the level of the base of the box in a low dispensing position.

The base 151 further comprises a substantially U-shaped channel 118 which further comprises stepped ridge 120 as described above. The channel 118 extends out from the base 151 forming a front face 152 similar to the front face 130 of the coupling member 103 described above. This is clearly illustrated in FIG. 19B where the front face 152 extends out and away from a sidewall 154. As such, the co-operating member 106 is recessed back from the front face 152, the front face 152 jutting out from the co-operating member 106. The base 152 further comprises sidewalls 154, 155 in communication with a stepped ledge 156, forming abutments 157,158. The abutments 157,158 are configured to engage with and support a front face of a box of a bag-in-box system. Ledge/shelf 156 is an extended version of shelves 124 and 125 of FIGS. 13 to 16 and is configured to support a portion of the base of the box. The stepped ledge 156 extends downwards from the sidewalls 154,155 and perpendicular to a horizontal plane B-B to form an abutment 159.

The base 151 is further configured to accommodate and support a portion of a bag pulled out from the box of a bag-in-box system, namely by a support means 160. The support means 160 comprises a well or cavity 161 formed by the sidewalls 154,155, the stepped ledge 156, and the co-operating portion 106. This is clearly seen in FIG. 18, a top plan view of the capture mechanism 150. In FIG. 18, the coupling member 103 lies flush with co-operating portion 106.

FIG. 19A illustrates a front view of the base 151 of the present invention. As can be clearly seen here, the abutment 159 extends downwards from the horizontal plane B-B from a base 162 of the support means 160. As with the embodiment shown in FIGS. 13 to 16, it will be appreciated that the capture mechanism of FIGS. 17 to 19 has multiple functions. The mechanism not only captures the spout but also ensures that a desired orientation of captured spout relative to the box is maintained. The capture mechanism is used to capture the spout in a low dispensing position, beneath the base of the box, by maintaining the base of the box in a raised position relative to the captured spout position. Ledge 156 and abutments 157,158 act together to maintain the height and depth separation between the captured spout and base of box.

It will be further appreciated that in either embodiment shown in FIGS. 13 to 19, the shelves 124, 125 and 156 extend a short distance rear of the capture mechanism, but may be deeper in alternative embodiments to support a greater portion of the base of the box.

One difference between the embodiment in FIGS. 13 to 16 and that in FIGS. 17 to 19 is that the latter captures the spout in a position well proud of the opening in the box. This may be more suitable for a unit wherein it is desirable for the spout to be manually activated and hence is required to be accessible from the front of the unit. The former embodiment wherein the capture mechanism stands less proud of the box when the spout is captured may be used when the tap is not manually activated to provide a more streamlined arrangement. For the former embodiment, less bag is required to be pulled from the box and hence no well is required to accommodate same.

Both embodiments of capture mechanism from FIGS. 13 to 19 may be used with a shelf of a dispensing unit similar to that shown in FIG. 7.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

The invention claimed is:

1. A capture mechanism for a dispensing spout of a bag-in-box liquid dispenser, the dispenser adapted to enable said dispensing spout protrude through at least the base of its box, the capture mechanism comprising:

a tap capture base comprising a spout receiving portion and side wings extending rearwardly from the spout receiving portion; and a coupling member adapted to cooperate with the spout receiving portion of the tap capture base;

wherein the spout receiving portion of the tap capture base and the coupling member each comprise a substantially U-shaped channel, which cooperate to define a substantially circular aperture for accommodating and capturing the spout of a bag in box liquid dispenser; and wherein each side wing of the tap capture base comprises:

at least one box-supporting shelf for maintaining the base of the box in a raised position relative to its spout when said spout is captured between the tap capture base and the coupling member; and at least one abutment arranged to abut the front face of the box and maintain the box at a sufficient distance from its spout when said spout is captured between the tap capture base and the coupling member, to maintain the captured spout in a position forward of the box to provide space for a portion of bag rear of the spout to project freely out of the box.

2. The capture mechanism of claim 1, further comprising a well for accommodating the portion of the bag rear of the spout.

3. A capture mechanism according to claim 1, wherein the coupling member is fully detachable from the spout-receiving portion.

4. A capture mechanism according to claim 1, wherein the coupling member is tethered to the spout-receiving portion.

5. A capture mechanism according to claim 1, wherein the coupling member and a co-operating section of the spout-receiving portion comprise complementary male and female formations.

6. A capture mechanism according to claim 1, wherein at least one of said coupling member and said spout-receiving portion comprises locking means.

7. A capture mechanism for a dispensing spout of a bag-in-box liquid dispenser, the dispenser adapted to enable said dispensing spout protrude through at least the base of its box, the capture mechanism comprising:

a platform adapted to co-operate with the base of a box of a bag-in-box liquid dispenser; and means for capturing a dispensing spout of a bag-in-box liquid dispenser, wherein in use with the platform mating with the box of a bag-in-box liquid dispenser adapted to enable its dispensing spout protrude through at least the base of its box, the capturing means lies in a plane beneath the platform to maintain the dispensing spout in a low dispensing position relative to the level of the base of the box.

8. A capture mechanism according to claim 7, wherein the capturing means comprises a block to securely accommodate the dispensing spout of a bag-in-box liquid dispenser.

9. A capture mechanism according to claim 8, wherein the block further comprises a locking means to releasably lock the capturing means to the platform.

10. A capture mechanism according to claim 8, wherein the block comprises a coupling member for releasably engaging with a spout-receiving portion of the block.

11. A capture mechanism according to claim 10, wherein the coupling member is pivotally attached to the spout-receiving portion.

12. A capture mechanism according to claim 10, wherein the coupling member is fully detachable from the spout-receiving portion.

13. A capture mechanism according to claim 10, wherein the coupling member and a co-operating section of the spout-receiving portion comprise complementary male and female formations.

14. A capture mechanism according to claim 8, wherein the block comprises a single unit having an open-sided internal channel configured to securely accommodate the dispensing spout.

15. A capture mechanism according to claim 14, wherein the block further comprises opposing jaws spaced apart so as to provide an opening into the internal channel.

16. A capture mechanism according to claim 7, wherein at least a portion of the platform is adapted to be received into an aperture in the base of a box of a bag-in-box dispenser.

17. A capture mechanism according to claim 7, wherein the platform forms part of a shelf for supporting a box.

18. A capture mechanism according to claim 7, wherein the platform comprises:

(i) an elongated section extending distal of the capturing means to cooperate with the base of the box;

(ii) a stepped ledge at a proximal end of the elongated section to clip onto the base of the box; and (iii) a flange at a distal end of the elongated section receivable into an aperture in the base of the box, the stepped ledge and flange adapted to operate in tandem to secure the platform to the base of the box.

19. A capture mechanism according to claim 7, wherein the platform further comprises a recess to accommodate a portion of the bag attached to the dispensing spout protruding through at least the base of the box.

20. A capture mechanism according to claim 18, wherein the flange comprises a raised lip at a distal end of the elongated section.

21. A capture mechanism for a dispensing spout of a bag-in-box liquid dispenser, the dispenser adapted to enable said dispensing spout protrude through at least the base of its box, the capture mechanism comprising:

a shelf adapted to support at least a portion of the base of a box of a bag-in-box liquid dispenser; and means for capturing a dispensing spout of a bag-in-box liquid dispenser, wherein in use with the shelf supporting at least a portion of the box of a bag-in-box liquid dispenser adapted to enable its dispensing spout protrude through at least the base of its box, the capturing means lies in a plane beneath the shelf to maintain the dispensing spout in a low dispensing position relative to the level of the base of the box.

22. A unit for use in dispensing a liquid from a bag-in-box liquid dispenser, the dispenser adapted to enable a dispensing spout protrude through at least the base of the box, the unit comprising:

a capture mechanism according to any one of claims 1, 7 and 21 and a shelf adapted to accommodate the capture mechanism.

23. A unit according to claim 22, wherein the shelf comprises:

an upper surface for supporting the base of a box, the upper surface having defined therein a cavity into which the capturing means of the capture mechanism is accommodatable.

24. A unit according to claim 23, wherein the shelf further comprises engagement means within the cavity to co-operate with at least one corresponding tab provided on said capturing means to releasably lock the capture mechanism to the shelf.

25. A unit according to claim 23, wherein the shelf further comprises releasable engagement means selected from the group consisting of a magnet, a clip, and complimentary engagement formations.

26. A unit according to claim 25, wherein the shelf further comprises an actuator for releasing the capture mechanism from the releasable engagement means of the shelf.

27. A unit according to claim 22, wherein the shelf further comprises a heat transfer contact plate to engage with a bag in a bag-in-box dispenser and chill the liquid therein.

* * * * *